US006015645A

United States Patent [19]

Murti et al.

[11] Patent Number: 6,015,645

[45] Date of Patent: Jan. 18, 2000

[54] PHOTOCONDUCTIVE IMAGING MEMBERS

[75] Inventors: Dasarao K. Murti, Mississauga; Daniel A. Foucher, Toronto, both of Canada

[73] Assignee: Xerox Corporation, Stamford, Conn.

[21] Appl. No.: 09/086,743

[22] Filed: May 29, 1998

[51] Int. Cl.[7] ..... G03G 5/10

[52] U.S. Cl. ..... 430/59; 430/64

[58] Field of Search ..... 430/64, 65, 58.8

[56] References Cited

U.S. PATENT DOCUMENTS

| | | | |
|---|---|---|---|
| 3,121,006 | 2/1964 | Middleton et al. | 96/1 |
| 4,265,990 | 5/1981 | Stolka et al. | 430/59 |
| 4,298,697 | 11/1981 | Baczek et al. | 521/27 |
| 4,338,390 | 7/1982 | Lu | 430/106 |
| 4,464,450 | 8/1984 | Teuscher | 430/59 |
| 4,560,635 | 12/1985 | Hoffend et al. | 430/106.6 |
| 4,822,705 | 4/1989 | Fukagai et al. | 430/64 |
| 4,921,773 | 5/1990 | Melnyk et al. | 430/132 |
| 5,244,762 | 9/1993 | Spiewak et al. | 430/64 |
| 5,372,904 | 12/1994 | Yu et al. | 430/64 |
| 5,385,796 | 1/1995 | Spiewak et al. | 430/64 |
| 5,473,064 | 12/1995 | Mayo et al. | 540/141 |
| 5,482,811 | 1/1996 | Keoshkerian et al. | 430/135 |
| 5,521,043 | 5/1996 | Listigovers et al. | 430/59 |
| 5,874,192 | 2/1999 | Fuller et al. | 430/58 |

*Primary Examiner*—John Goodrow
*Attorney, Agent, or Firm*—E. O. Palazzo

[57] ABSTRACT

A photoconductive imaging member comprised of a supporting substrate, a hole blocking layer, an optional adhesive layer, a photogenerator layer, and a charge transport layer, and wherein said blocking layer is comprised of a polyhaloalkylstyrene.

38 Claims, No Drawings

PHOTOCONDUCTIVE IMAGING MEMBERS

RELATED PATENTS

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$ for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1', 2'-b)anthra(2,1,9-def:6,5,10-d'e'f') diisoquinoline-6,11-dione and bisbenzimidazo(2,1-a:2',1'-a) anthra(2,1,9-def:6,5,10-d'e'f')diisoquinoline-10, 21-dione, reference U.S. Pat. No. 4,587,189, the disclosure of which is totally incorporated herein by reference; and as a top layer a second charge transport layer.

The appropriate components of the above patents may be selected for the invention of the present application in embodiments thereof, and more specifically, there can be selected for the imaging members of the present invention the substrates, charge transport layers, resin binders and hydroxygallium phthalocyanine photogenerating pigments of these patents.

BACKGROUND OF THE INVENTION

This invention is generally directed to imaging members, and more specifically, the present invention is directed to multilayered imaging members with photogenerating layers, sensitive, for example, to a wavelength of from about 550 to about 950 nanometers, and which layer is preferably comprised of a hydroxygallium phthalocyanine, reference for example U.S. Pat. No. 5,482,811, the disclosure of which is totally incorporated herein by reference, and especially Type V hydroxygallium phthalocyanine, and wherein the imaging member contains as an undercoat layer, preferably in contact with the supporting substrate, a polyhaloalkylstyrene, especially a polychloromethylstyrene (PCMS), or modifications, or derivatives thereof, and wherein the undercoat layer can be generated by, for example, the curing and thus crosslinking of the PCMS. The imaging members of the present invention in embodiments exhibit excellent cyclic stability, independent layer discharge, and substantially no adverse changes in performance over extended time periods. The aforementioned photoresponsive, or photoconductive imaging members can be negatively charged when the photogenerating layers are situated between the hole transport layers and the substrate, or positively charged when the hole transport layers are situated between the photogenerating layers and the supporting substrates. Processes of imaging, especially xerographic imaging and printing, are also encompassed by the present invention.

The invention layered photoconductive imaging members can be selected for a number of different known imaging and printing processes including, for example, electrophotographic imaging processes, especially xerographic imaging and printing processes wherein negatively charged or positively charged images are rendered visible using toner compositions of an appropriate charge polarity. Moreover, the imaging members of this invention are preferably useful in color xerographic applications where several color printings can be achieved in a single pass.

PRIOR ART

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is substantially incapable of transporting for any significant distance injected charge carriers generated by the photoconductive particles.

The photoconducting imaging member may optionally contain a charge blocking layer situated between the conductive substrate and the photogenerating layer. This layer may comprise metal oxides, such as aluminum oxide and the like, or materials such as silanes or polyesters. The primary purpose of this layer is to prevent charge injection from the substrate during and after charging. In addition, the photoconductive imaging member may also contain an adhesive interface layer situated between the charge blocking layer and the photogenerating layer. This layer may comprise a polymeric material such as a polyester, polyvinylbutaryl and the like.

In U.S. Pat. No. 4,464,450 there is disclosed an imaging member with a siloxane blocking layer. The layer can be comprised of a siloxane reaction product of a hydrolyzed silane having reactive OH and ammonium groups attached to the silicon atoms of the siloxane, the blocking layer being contiguous to a metal oxide layer of a conductive metal anode layer. Also, an electrophotographic imaging member with a blocking layer containing uncrosslinked chemically modified copolymers is described in U.S. Pat. No. 5,244,762. The blocking layer of this patent includes an uncrosslinked copolymer derived from a vinyl hydroxy ester or vinyl hydroxy amide repeat units chemically modified at a nucleophilic hydroxyl group by a monofunctional electrophile. A photoconductive charge blocking layer including a water insoluble unmodified hydroxy methacrylate polymer is disclosed in U.S. Pat. No. 5,385,796. An imaging member with a hole blocking layer comprising a reaction product of a material selected from the group consisting of a hydrolyzed organozirconium compound, a hydrolyzed organotitanium compound, a hydroxyalkyl cellulose, a hydrolyzed organoaminosilane and a metal oxide surface is disclosed in U.S. Pat. No. 5,372,904.

Although insulating polymers can block hole injection from the underlying conducting substrate, their maximum thickness is limited by the inefficient transport of the photoinjected electrons from the charge generation layer to the conducting substrate. If the charge blocking layer is very thick, for example about 0.5 micrometer, it can block the passage of both holes and electrons and lead to a trapping of the photoinjected electrons and a resultant increase in the residual voltage. Thus, the hole blocking layer should be very thin, for example about 0.1 micrometer and this thin blocking layer coating often results in another problem, namely the incomplete coverage of the underlying substrate due to inadequate wetting on localized surface areas of the substrate. Further, blocking layers that are very thin, for example less than about 0.5 micrometer, and more specifically from about 0.1 to about 0.4 micrometer in thickness are more susceptible to the formation of pinholes which allow both holes and electrons to leak through and result in print defects.

There is a continuing need for multilayered imaging members with improved blocking layers capable of forming thick uniform coatings, having greater resistance to cracking, greater adhesion to adjacent layers and excellent electrical properties.

SUMMARY OF THE INVENTION

It is a feature of the present invention to provide imaging members thereof with many of the advantages illustrated herein.

Another feature of the present invention relates to the provision of improved layered photoresponsive imaging members with photosensitivity to near infrared radiations.

It is yet another feature of the present invention to provide improved layered photoresponsive imaging members with a sensitivity to visible light, and which members contain a polyhaloalkyl styrene or acrylated polyhaloalkyl styrene, or modifications thereof, blocking, or undercoat (UCL) layer.

In a further feature of the present invention there are provided imaging members preferably containing as the photogenerating pigments Type V hydroxygallium phthalocyanine with XRPD peaks at Bragg angles of 7.4, 9.8, 12.4, 16.2, 17.6, 18.4, 21.9, 23.9, 25.0, 28.1, and the highest peak at 7.4 degrees 2θ (2 theta). All the 2 theta values reacted herein throughout refer to diffraction of Cu K-alpha radiation (wavelength=1.54 Angstroms).

The present invention relates to photoconductive imaging members comprised of a supporting substrate, an undercoat, or hole blocking layer of a preferred thickness of about 0.3 to about 3 microns, 0.1 to about 2 micrometers, for example, or more preferably about 0.5 micrometer, an optional adhesive layer, a photogenerating layer of, for example, hydroxygallium phthalocyanine, and a charge transport layer, preferably containing aryl amines, such as those of the U.S. Pat. No. 4,265,990 patent recited herein. The charge transport layer can be situated between the photogenerating layer and the hole blocking layer in embodiments of the present invention. Also, the present invention relates to a method of imaging which comprises generating an electrostatic latent image on the imaging member, developing the image with a known toner, transferring the image to a substrate, such as paper, and fixing the image by, for example, heat. The hydroxygallium photogenerating layer, which is preferably comprised of hydroxygallium phthalocyanine Type V, is in embodiments comprised of about 50 weight percent of the Type V and about 50 weight percent of a resin binder like polystyrene/polyvinylpyrridine.

Aspects of the present invention relate to a photoconductive imaging member comprised of a supporting substrate, a hole blocking layer, an optional adhesive layer, a photogenerator layer, and a charge transport layer, and wherein said blocking layer is comprised of a polyhaloalkylstyrene; an imaging member with a polyhaloalkylstyrene of polychloromethylstyrene; an imaging member with a polyhaloalkylstyrene of copoly(chloromethylstyrene-styrene), copoly (chloromethylstyrene-acrylated methyl styrene), copoly (chloromethyl styrene-dimethylaminoethylacrylated methyl styrene) or copoly(chloromethylstyrene-trimethylaminoethylacrylated methyl styrene), and wherein the photogenerator layer is comprised of a hydroxygallium phthalocyanine; an imaging member containing a polyhaloalkylstyrene with a $M_w$ of about 2,500 to about 1,000,000, or an imaging member wherein the polyhaloalkylstyrene possesses a $M_n$ of about 2,000 to about 800,000; an imaging member containing a polyhaloalkylstyrene that is cured; and wherein curing can be accomplished by heating; an imaging member containing a crosslinked polyhaloalkylstyrene; an imaging member wherein curing of the polyhaloalkylstyrene is accomplished by ultraviolet processes; an imaging member wherein crosslinking is from about 5 to about 95 percent; an imaging member wherein the photogenerator layer is situated between the substrate and the charge transport layer; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerator layer is of a thickness of from about 0.05 to about 10 microns; an imaging member wherein the transport layer is of a thickness of from about 5 to about 30 microns; an imaging member wherein the photogenerating layer is dispersed in a resinous binder in an amount of from about 5 percent by weight to about 95 percent by weight; an imaging member wherein the resinous binder is selected from the group consisting of polyesters, polyvinyl butyrals, polycarbonates, polystyrene-b-polyvinyl pyrridine, and polyvinyl formals; an imaging member wherein the charge transport layer comprises aryl amine molecules of, for example, the formula

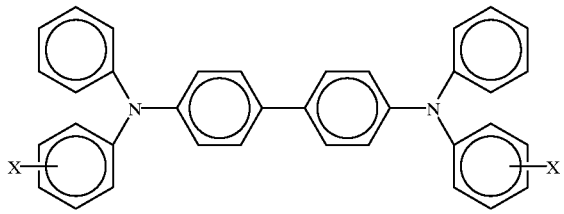

wherein X is selected from the group consisting of alkyl and halogen, and wherein the aryl amine is dispersed in a highly insulating and transparent resinous binder; an imaging member wherein the charge transport resinous binder is selected from the group consisting of polycarbonates and polystyrenes; an imaging member wherein the aryl amines are molecules comprised of N,N'-diphenyl-N,N-bis(3-methyl phenyl)-1,1'-biphenyl-4,4'-diamine; a method of imaging which comprises generating an electrostatic latent image on the imaging member illustrated herein and containing a polyhaloalkylstyrene, developing the latent image, and transferring the developed electrostatic image to a suitable substrate; an imaging member wherein the photogenerating layer is comprised of hydroxygallium phthalocyanine Type V; an imaging member wherein the Type V hydroxygallium phthalocyanine is prepared by hydrolyzing a gallium phthalocyanine precursor pigment by dissolving the hydroxygallium phthalocyanine in a strong acid and then reprecipitating the resulting dissolved pigment in basic aqueous media, removing any ionic species formed by washing with water, concentrating the resulting aqueous slurry comprised of water and hydroxygallium phthalocyanine to a wet cake, removing water from said wet cake by drying in oven, and subjecting said resulting dry pigment to mixing with the addition of a second solvent; a photoconductive imaging member wherein the supporting substrate has a thickness of from about 3 to 100 mils, and wherein the hole blocking layer has a thickness of from about 0.1 to 2 micrometers; a photoconductive imaging member wherein the adhesive layer comprises a polymeric material selected from the group consisting of polyester, and polyvinylbutaryl and which adhesive has a thickness of from about 0.01 to 0.1 micrometer; an imaging member containing a polyhaloalkylstyrene of copoly(halomethyl styrene-styrene), copoly(halomethylstyrene-acrylated methyl styrene), copoly(halomethylstyrene-acrylated methyl styrene-styrene), copoly(halomethylstyrene-dimethylaminoethylacrylated methyl styrene), copoly (halomethylstyrene-trimethylaminoethylacrylated methyl styrene, or mixtures thereof, and wherein the photogenerator layer is comprised of a hydroxygallium phthalocyanine; an imaging member wherein the blocking layer is of a thickness of from about 0.1 to about 3 microns; an imaging member comprised of a polyhaloalkylstyrene, a photogenerating layer and a charge transport; and an imaging member wherein said polyhaloalkylstyrene is an acrylated polyhaloalkylstyrene; and an imaging member wherein the acrylated polyhaloalkylstyrene is crosslinked.

The hole blocking layer is preferably comprised of a polyhaloalkylstyrene, such as PCMS, a modified PCMS, and the like prepared, for example, to causing a curing, or heating at about −100° C. to about 250° C. and thus crosslinking from about 5 to 75 percent of the functional sites on the PCMS, or polyhaloalkylstyrene. More specifically, the PCMS (or polyhaloalkylstyrene throughout) is cured by exposure to light, typically by exposure to sufficient UV radiation to crosslink functional sites on the polymer, such as acrylic groups and/or by heating processes such as annealing at temperatures from 150° C. to 250° C., which causes the crosslinking of the halo like chloromethyl groups by the elimination of hydrochloric acid. The PCMS materials can be considered homopolymers of poly (chloromethylstyrene) and random copolymers comprised of polystyrene and poly(chloromethylstyrene). In embodiments of the present invention, there are provided processes for the preparation of an intermediate molecular weight, narrowly dispersed, poly(chloromethylstyrene) or copoly (chloromethylstyrene-styrene) using a stable free radical moderated polymerization procedure, followed by reacting the polymers generated with a reactive acrylate, alkacrylate salt, or di(or trialkyl)alkylaminoacrylate in, for example, sequential reactions, or alternatively, by a one pot procedure thereby forming a potentially photopatternable acrylated, alkacrylated, or dialkyl(or trialkyl)aminoacrylated polymer. The acrylated, alkacrylated, or dialkyl(or trialkyl) aminoacrylated polymer can be functionalized where from 5 to 70 percent of the chloromethyl sites have been converted to functional sites. The polymers suitable for these applications include poly(chloromethylstyrene), copoly (chloromethylstyrene-styrene), copoly (chloromethylstyrene-acrylated methyl styrene), copoly (chloromethylstyrene-acrylated methyl styrene-styrene), copoly(chloromethylstyrene-dimethylaminoethylacrylated methyl styrene).

In a negatively charged photoresponsive imaging member, the function of the hole blocking layer is to prevent the injection of holes from the conducting substrate into the charge generation layer either before or during photodischarge of the imaging member. The consequences of inefficient hole blocking are low charge acceptance, for example about 500 V and/or higher dark decay, for example about 100 V/second. In addition, the hole blocking layer should transport electrons from the charge generation layer to the conducting substrate. Further, on repeated cycling, there could be increase in residual potential from about 10 V to about 100 V and decrease in the charge acceptance from about 800 V to about 600 V leading to an overall degradation in electrical properties. The measurements of the initial charge acceptance, dark decay and changes due to repeated cycling for 10,000 cycles of imaging members fabricated without a hole blocking layer and an imaging member with a hole blocking layer can be used to determine the effectiveness of the hole blocking layer.

One negatively charged photoresponsive imaging member of the present invention is comprised, in the order indicated, of a supporting substrate, a PCMS hole blocking layer, an adhesive layer comprised, for example, of a polyester 49,000 available from Goodyear Chemical, a photogenerator layer comprised of Type V hydroxygallium phthalocyanine, optionally dispersed in an inactive polymer binder, and a hole transport layer thereover comprised of N,N'-diphenyl-N,N'-bis(3-methyl phenyl)-1,1'-biphenyl-4,4'-diamine dispersed in a polycarbonate binder.

Examples of substrate layers selected for the imaging members of the present invention can be opaque or substantially transparent, and may comprise any suitable material with, for example, the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonates commercially available as MAKROLON®.

The thickness of the substrate layer depends on many factors, including economical considerations, thus this layer may be of substantial thickness, for example over 3,000 microns, or of a minimum thickness of about, for example, 25 microns providing there are no adverse effects on the imaging member. In embodiments, the thickness of this layer is from about 75 microns to about 300 microns.

Generally, the thickness of the photogenerator layer depends on a number of factors, including the thicknesses of the other layers and the amount of photogenerator component contained in this layer. Accordingly, this layer can be of a thickness of from about 0.05 micron to about 10 microns, and more specifically, from about 0.25 micron to about 1 micron, and the photogenerator component is present in this layer in an amount of, for example, about 30 to 75 about percent by volume. The maximum thickness of the layers in an embodiment is dependent primarily upon factors, such as photosensitivity, electrical properties and mechanical considerations. The optional binder resin for the photogenerating layer may be selected from a number of known polymers, reference U.S. Pat. No. 3,121,006, the disclosure of which is totally incorporated herein by reference, and more specifically, poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethylformamide, dimethylacetamide, butyl acetate, ethyl acetate, methoxyethyl acetate, and the like.

Examples of photogenerating layer components for the photogenerating layer, in addition to the hydroxygallium phthalocyanines are trigonal selenium, metal phthalocyanines, metal free phthalocyanines, perylenes, and other known suitable components.

The coating of the photogenerator layers in embodiments of the present invention can be accomplished with spray, dip or wire-bar methods such that the final dry thickness of the photogenerator layer is, for example, preferably from about 0.01 to about 30 microns, and more preferably from about 0.1 to about 15 microns after being dried at about 40° C. to about 150° C. for about 5 to about 90 minutes.

As adhesives usually in contact with the supporting substrate, there can be selected various known substances inclusive of polyesters, polyamides, poly(vinyl butyral), poly(vinyl alcohol), polyurethane and polyacrylonitrile. This layer is of a thickness of, for example, from about 0.001 micron to about 1 micron. Optionally, this layer may contain conductive and nonconductive particles, such as zinc oxide, titanium dioxide, silicon nitride, carbon black, and the like, to provide, for example, in embodiments of the present invention further desirable electrical and optical properties.

Aryl amines selected for the hole transporting layers, which generally is of a thickness of from about 5 microns to about 75 microns, and preferably of a thickness of from about 10 microns to about 40 microns, include those of U.S. Pat. No. 4,265,990, the disclosure of which is totally incorporated herein by reference, and more specifically, molecules of the following formula

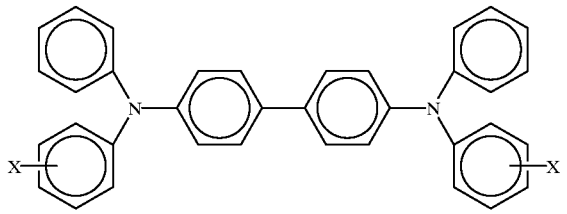

dispersed in a highly insulating and transparent polymer binder, wherein X is an alkyl group or a halogen, and especially is selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, inclusive of, for example, those illustrated in U.S. Pat. Nos. 4,921,773 and 4,464,450, the disclosures of which are totally incorporated herein by reference.

Examples of the highly insulating and transparent polymer binder material for the transport layers include materials such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

The photoconductive imaging member of the present invention can be prepared by a number of methods, such as the coating of the layers on a substrate. More specifically the photoconductive imaging member can be prepared by coating solutions or dispersions thereof by the use of a spray coater, dip coater, extrusion coater, slot coater, doctor blade coater, and the like, and thereafter dried from about 40° C. to about 200° C. for from about 10 minutes to about 1 hour under stationary conditions or in an air flow.

Also, included within the scope of the present invention are methods of imaging and printing with the photoresponsive devices illustrated herein. These methods generally involve the formation of an electrostatic latent image on the imaging member, followed by developing the image with a toner composition comprised, for example of thermoplastic resin, pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated.

EXAMPLE I

Alkoxy-bridged Gallium Phthalocyanine Dimer Synthesis Using Gallium Methoxide Obtained From Gallium Chloride and Sodium Methoxide In Situ To a 1 liter round bottomed flask were added 25 grams of $GaCl^3$ and 300 milliliters of toluene, and the mixture was stirred for 10 minutes to form a solution. Then, 98 milliliters of a 25 weight percent sodium methoxide solution (in methanol) were added while cooling the flask with an ice bath to keep the contents below 40° C. Subsequently, 250 milliliters of ethylene glycol and 72.8 grams of o-phthalodinitrile were added. The methanol and toluene were quickly distilled off over 30 minutes while heating from 70° C. to 135° C., and then the phthalocyanine synthesis was performed by heating at 195° C. for 4.5 hours. The alkoxy-bridged gallium phthalocyanine dimer was isolated by filtration at 120° C. The product was then washed with 400 milliliters of DMF at 100° C. for 1 hour and filtered. The product was then washed with 600 milliliters of deionized water at 60° C. for 1 hour and filtered. The product was then washed with 600 milliliters of methanol at 25° C. for 1 hour and filtered. The product was dried at 60° C. under vacuum for 18 hours. The alkoxy-bridged gallium phthalocyanine dimer, 1,2-di(oxogallium phthalocyaninyl) ethane, was isolated as a dark blue solid in 77 percent yield. The dimer product was characterized by elemental analysis, infrared spectroscopy, $^1H$ NMR spectroscopy and X-ray powder diffraction. Elemental analysis showed the presence of only 0.10 percent of chlorine. Infrared spectroscopy: major peaks at 573, 611, 636, 731, 756, 775, 874, 897, 962, 999, 1069, 1088, 1125, 1165, 1289, 1337, 1424, 1466, 1503, 1611, 2569, 2607, 2648, 2864, 2950, and 3045 $cm^{-1}$; $^1H$ NMR spectroscopy (TFA-d/$CDCl_3$ solution, 1:1 v/v, tetramethylsilane reference): peaks at (10 ppm±0.01 ppm) 4.00 (4H), 8.54 (16H), and 9.62 (16H); X-ray powder diffraction pattern: peaks at Bragg angles (2 theta ±0.2°) of 6.7, 8.9, 12.8, 13.9, 15.7, 16.6, 21.2, 25.3, 25.9, and 28.3 with the highest peak at 6.7 degrees 2θ (2 theta). 2 theta values reported refer to diffraction of Cu K-alpha radiation (wavelength=1.542 Angstroms).

EXAMPLE II

Hydrolysis of Alkoxy-bridged Gallium Phthalocyanine to Hydroxygallium Phthalocyanine (Type I)

The hydrolysis of alkoxy-bridged gallium phthalocyanine synthesized in Example I to hydroxygallium phthalocyanine was performed as follows. Sulfuric acid (94 to 96 percent, 125 grams) was heated to 40° C. in a 125 milliliter Erlenmeyer flask, and then 5 grams of the chlorogallium phthalocyanine were added. Addition of the solid was completed in approximately 15 minutes, during which time the temperature of the solution increased to about 48° C. The acid solution was then stirred for 2 hours at 40° C., after which it was added in a dropwise fashion to a mixture comprised of concentrated (about 30 percent) ammonium hydroxide (265 milliliters) and deionized water (435 milliliters), which had been cooled to a temperature below 5° C. The addition of the dissolved phthalocyanine was completed in approximately 30 minutes, during which time the temperature of the solution increased to about 40° C. The reprecipitated phthalocyanine was then removed from the cooling bath and allowed to stir at room temperature for 1 hour. The resulting phthalocyanine was then filtered through a porcelain funnel fitted with a Whatman 934-AH grade glass fiber filter. The resulting blue solid was redispersed in fresh deionized water by stirring at room temperature for 1 hour and filtered as before. This process was repeated at least three times until the conductivity of the filtrate was <20 μS. The filtercake was oven dried overnight at 50° C. to give 4.75 grams (95 percent) of Type I HOGaPc, identified by infrared spectroscopy and X-ray powder diffraction. Infrared spectroscopy: major peaks at 507, 573, 629, 729, 756, 772, 874, 898, 956, 984, 1092, 1121, 1165, 1188, 1290, 1339, 1424, 1468, 1503, 1588, 1611, 1757, 1835, 1951, 2099, 2207, 2280, 2384, 2425, 2570, 2608, 2652, 2780, 2819, 2853, 2907, 2951, 3049 and 3479 (broad) $cm^{-1}$; X-ray diffraction pattern: peaks at Bragg angles of 6.8, 13.0, 16.5, 21.0, 26.3 and 29.5 with the highest peak at 6.8 degrees 2θ (2 theta+/−0.2°). The 2 theta values reported refer to diffraction of Cu K-alpha radiation (wavelength=1.542 Angstroms).

EXAMPLE III

Conversion of Type I Hydroxygallium Phthalocyanine to Type V

The Type I hydroxygallium phthalocyanine pigment obtained in Example II was converted to Type V HOGaPc as follows. The Type I hydroxygallium phthalocyanine pigment (3.0 grams) was added to 25 milliliters of N,N-dimethylformamide in a 60 milliliter glass bottle containing 60 grams of glass beads (0.25 inch in diameter). The bottle was sealed and placed on a ballmill overnight (18 hours). The solid was isolated by filtration through a porcelain funnel fitted with a Whatman GF/F grade glass fiber filter, and washed in the filter using several 25 milliliter portions of acetone. The filtered wet cake was oven dried overnight at 50° C. to provide 2.8 grams of Type V HOGaPc which was identified by infrared spectroscopy and X-ray powder diffraction. Infrared spectroscopy: major peaks at 507, 571, 631, 733, 756, 773, 897, 965, 1067, 1084, 1121, 1146, 1165, 1291, 1337, 1425, 1468, 1503, 1588, 1609, 1757, 1848, 1925, 2099, 2205, 2276, 2384, 2425, 2572, 2613, 2653, 2780, 2861, 2909, 2956, 3057 and 3499 (broad) $cm^{-1}$; X-ray diffraction pattern: peaks at Bragg angles of 7.4, 9.8, 12.4, 12.9, 16.2, 18.4, 21.9, 23.9, 25.0 and 28.1 with the highest peak at 7.4 degrees 2θ (2 theta+/−0.2°). The 2 theta values reported refer to diffraction of Cu K-alpha radiation (wavelength=1.542 Angstroms).

EXAMPLE IV

Homopolymerization of Chloromethylstyrene

A poly(chloromethylstyrene) polymer of the formula

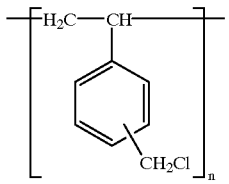

PCMS wherein n is approximately 116 was prepared as follows. Into a 50 milliliter, 3 necked round bottom flask equipped with an argon purge, reflux condenser, and stirring rod and paddle, was added a stable free radical agent 2,2'6,6'-tetramethyl-1-piperidinyloxy (TEMPO, 104 milligrams, 0.671 mmol), a free radical initiator benzoyl peroxide (BPO 123 milligrams, 0.508 mmol), and a monomer chloromethylstyrene (CMS, 20.5 grams, 134 mmol). The solution was then immersed half way into a preheated oil bath (130° C.) and then stirred for 4 hours. The reaction mixture was then cooled to approximately 80° C. and diluted with 10 milliliters of toluene and 40 milliliters of tetrahydrofuran. White polymer powder was recovered by precipitation of the diluted solution into 2 liters of methanol and filtered. The polymer was redissolved in THF and then precipitated a second time in methanol, filtered, and vacuum dried overnight at 60° C. Total recovered polymer of poly (chloromethylstyrene) was 13.4 grams. GPC Data: $M_w$=23,400, $M_n$=17,700, Polydispersity (PD)=1.32. Thin films, (thickness of from about 0.1 to 2.0 micrometers) of the homopolymer can be readily crosslinked with heat by a thermal cure that was effected at about 260° C. between unreacted chloromethyl groups and aromatic rings of the polystyrene chain to form methylene bridges. The extent of crosslinking of the chloromethyl groups can vary from between 5 to up to 70 percent, and was typically about 60 to 65 percent as measured by elemental analysis or Rutherford Backscattering Experiments to detect for residual chlorine.

EXAMPLE V

Homopolymerization of Chloromethylstyrene

A poly(chloromethylstyrene) polymer material of the formula PCMS of Example IV wherein n is approximately 200 was prepared as follows. Into a 50 milliliter 3 necked round bottom flask equipped with an argon purge, reflux condenser, and stirring rod with a paddle, was added 2,2',6,6'-tetramethyl-1-piperidinyloxy (TEMPO, 70 milligrams, 0.451 mmol), benzoyl peroxide (BPO 83 milligrams, 0.342 mmol), and chloromethylstyrene (CMS, 20.1 grams, 132 mmol). The solution was then immersed half way into a preheated oil bath (130° C.) and then stirred for 4 hours. The reaction mixture was then cooled to approximately 80° C. and diluted with 10 milliliters of toluene and 40 milliliters of tetrahydrofuran. White polymer powder was recovered by precipitation of the diluted solution into 2 liters of methanol and filtered. The polymer of poly(chloromethylstyrene) polymer was redissolved in THF, and precipitated second time in methanol, filtered, and vacuum dried overnight, about 18 hours, at 60° C. Total recovered polymer was 12.5 grams. GPC Data: $M_w$=41,600, $M_n$=29,500, PD=1.41. Thin films of the homopolymer can be readily crosslinked with heat by a thermal cure that was accomplished at about 260° C. between unreacted chloromethyl groups and aromatic rings of the polystyrene chain to form methylene bridges. The extent of crosslinking of the chloromethyl groups varies from between 45 to up to 50 percent as measured by elemental analysis or Rutherford Backscattering Experiments to detect for residual chlorine.

EXAMPLE VI

Homopolymerization of Chloromethylstyrene

A poly(chloromethylstyrene) material of the formula PCMS of Example IV wherein n is approximately 140 was prepared as follows. Into a 50 milliliters 3 necked round bottom flask equipped with an argon purge, reflux condenser, and stirring rod with a paddle, was added 2,2',6,6'-tetramethyl-1-piperidinyloxy (TEMPO, 167 milligrams, 1,07 mmol), benzoyl peroxide (BPO 196 milligrams, 0.813 mmol), and chloromethylstyrene (CMS, 20.1 grams, 132 mmol). The solution was then immersed half way into a preheated oil bath (130° C.) and then stirred for 4 hours. The reaction mixture was then cooled to approximately 80° C. and diluted with 10 milliliters of toluene and 40 milliliters of tetrahydrofuran. White polymer powder was recovered by precipitation of the diluted solution into 2 liters of methanol and filtered. The polymer was redissolved in THF, and precipitated a second time in methanol, filtered, and vacuum dried overnight, about 18 hours throughout, at 60° C. Total recovered polymer of poly(chloromethylstyrene) was 12.3 grams. GPC Data: $M_w$=26,300, $M_n$=21,200, PD=1.41. Thin films of the homopolymer for UCL applications can be readily crosslinked by a thermal cure that was accomplished at about 250° C. between unreacted chloromethyl groups and aromatic rings of the polystyrene chain to form methylene bridges. The extent of crosslinking of the chloromethyl groups can vary from between 5 to up to 70 percent, and was for this Example about 50 to 55 percent as measured by elemental analysis or Rutherford Backscattering Experiments to detect for residual chlorine.

EXAMPLE VII

Random Copolymerization of Chloromethylstyrene and Styrene (9:1 PCMS/PS)

A copolymer, copoly(chloromethylstyrene-styrene), of the formula

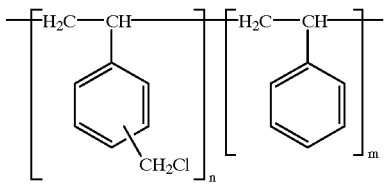

wherein n is approximately 130 and m is approximately 15 was prepared as follows. Into a 50 milliliters 3 necked round bottom flask equipped with an argon purge, reflux condenser, and stirring rod with a paddle, was added 2,2',6,6'-tetramethyl-1-piperidinyloxy (TEMPO, 104 milligrams, 0.671 mmol), benzoyl peroxide (BPO 147 milligrams, 0.606 mmol, styrene (2.93 grams, 19.2 mmol), and chloromethylstyrene (CMS, 18.0 grams, 118 mmol). The solution was then immersed half way into a preheated oil bath (130° C.) and then stirred for 4 hours. The reaction mixture was then cooled to approximately 80° C. and diluted with 10 milliliters of toluene and 40 milliliters of tetrahydrofuran. White polymer powder was recovered by precipitation of the diluted solution into 2 liters of methanol and filtered. The polymer was redissolved in THF, and precipitated second time in methanol, filtered, and vacuum dried overnight, 18 hours throughout, at 60° C. Total recovered polymer of copoly(chloromethylstyrene-styrene) was 10.4 grams. GPC Data: $M_w$=26,400, $M_n$=21,200, PD=1.24. Thin films of the copolymer can be readily crosslinked with heat by a thermal cure that was accomplished at about 260° C. between unreacted chloromethyl groups and aromatic rings of the polystyrene chain to form methylene bridges. The extent of crosslinking of the chloromethyl groups can vary from between 5 to up to 70 percent, and was about 40 to 45 percent as measured by elemental analysis or Rutherford Backscattering Experiments to detect for residual chlorine.

EXAMPLE VIII

Random Copolymerization of Chloromethylstyrene and Styrene (1:1=PCMS/PS)

A random copolymer, copoly(chloromethylstyrene-styrene), of the formula PCMS/PS of Example VII, wherein n is approximately 45 and m is approximately 45 was prepared as follows. Into a 50 milliliter 3 necked round bottom flask equipped with an argon purge, reflux condenser, and stirring rod with a paddle, was added 2,2',6,6'-tetramethyl-1-piperidinyloxy (TEMPO, 52 milligrams, 0.333 mmol), benzoyl peroxide (BPO 73 milligrams, 0.303 mmol, styrene (5.0 grams, 48 mmol) and chloromethylstyrene (CMS, 7.32 grams, 48 mmol). The solution was then immersed half way into a preheated oil bath (130° C.) and then stirred for 4 hours. The reaction mixture was then cooled to approximately 80° C. and diluted with 10 milliliters of toluene and 40 milliliters of tetrahydrofuran. White polymer powder was recovered by precipitation of the diluted solution into 2 liters of methanol and filtered. The polymer was redissolved in THF, and precipitated second time in methanol, filtered, and vacuum dried overnight at 60° C. Total recovered polymer of copoly (chloromethylstyrene-styrene) was 6.0 grams. GPC Data: $M_w$=13,900, $M_n$=11,400, PD=1.22. Thin films of the copolymer can be readily crosslinked with heat by a thermal cure that occurs at about 260° C. between unreacted chloromethyl groups and aromatic rings of the polystyrene chain to form methylene bridges. The extent of crosslinking of the chloromethyl groups can vary from between 5 to up to 70 percent, and was about 50 to 55 percent as measured by elemental analysis or Rutherford Backscattering Experiments to detect for residual chlorine.

EXAMPLE IX

Acrylation of Homopoly(chloromethylstyrene) of Example IV

A general procedure follows for all subsequent acrylation/substitution reactions below.

To 10 grams of the PCMS polymer prepared in Example IV dissolved in 50 milliliters of dimethylacetamide were added 3 grams of the sodium salt of acrylic acid. The mixture was stirred at room temperature for 3 days in the dark. The partially acrylated polymer was recovered by precipitation of the polymer solution into one liter of a water/methanol mixture (75/25) and the white polymer recovered by filtration, washed with excess methanol (2×150 milliliters) and allowed to air dry. The sample was further dried to remove residual solvent by vacuum drying for 16 hours. The polymer was characterized by $^1$H NMR, which indicated by the ratio of the chloromethyl groups to acrylated methyl groups that approximately 25 percent of the chloromethyl groups had been substituted. The product is believed to be of the formula

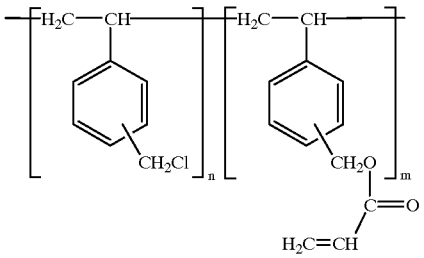

PCMS/PAMS

GPC revealed only the expected molecular weight increase due to acrylate substitution. Total recovered polymer of copoly(chloromethylstyrene-acrylated methyl styrene) (PCMS/PAMS), was 9.8 grams (95 percent yield). GPC Data: $M_w$24,700, $M_n$=18,200, PD=1.35. Thin films of this random copolymer can be developed by imagewise exposure of the material to radiation at a wavelength to which it is sensitive. The crosslinking was enhanced by the addition of sensitizers, such as Michler's Ketone 4,4'-bis (dimethylamino)benzophenone, and the like compounds. Exposure to, for example, ultraviolet radiation generally excites ethylenic bonds in the acrylate groups and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylate sites, and was about 75 to 80 percent crosslinked as measured by elemental analysis or Rutherford Backscattering Experiments to detect for residual chlorine and IR spectroscopy to detect for unreacted acrylate groups.

EXAMPLE X

Acrylation of Homopoly(chloromethylstyrene) of Example V

Example IX was repeated. The polymer product was characterized by $^1$H NMR, which showed 25 percent of the available chloromethyl groups had been substituted by acrylated methyl groups. GPC revealed only the expected molecular weight increase due to substitution. The total recovered polymer of copoly(chloromethylstyrene-acrylated methyl styrene) was 9.5 grams (91 percent yield). GPC Data: $M_w$=41,800, $M_n$=27,800, PD=1.50. Thin films of the resulting random copolymer can be developed by imagewise exposure of the material to radiation at a wavelength to which it is sensitive. The crosslinking is enhanced by the addition of sensitizers, such as Michier's Ketone 4,4'-bis (dimethylamino)benzophenone, and the like compounds. Exposure to, for example, ultraviolet radiation generally excites ethylenic bonds in the acrylate groups and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylol sites and was about 60 to 65 percent crosslinked as measured by elemental analysis or Rutherford Backscattering Experiments to detect for residual chlorine and IR spectroscopy to detect for unreacted acrylate groups.

EXAMPLE XI

Acrylation of Homopoly(chloromethylstyrene) from Example VI

Example IX was repeated. The polymer was characterized by $^1$H NMR, which indicated by the ratio of the chloromethyl groups to acrylated methyl groups that approximately 30 percent of the chloromethyl groups had been substituted. GPC revealed only the expected molecular weight increase due to substitution. The total recovered polymer of copoly (chloromethylstyrene-acrylated methyl styrene) was 9.0 grams (89 percent yield). GPC Data: $M_w$=27,600, $M_n$=22, 100, PD=1.25. Thin films of this random copolymer can be developed by imagewise exposure of the material to radiation at a wavelength to which it is sensitive. The crosslinking was enhanced by the addition of sensitizers, such as Michler's Ketone 4,4'-bis(dimethylamino)benzophenone, and the like compounds. Exposure to, for example, ultraviolet radiation generally excites ethylenic bonds in the acrylate groups and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylol sites and is about 65 to 70 percent crosslinked as measured by elemental analysis or Rutherford Backscattering Experiments to detect for residual chlorine and IR spectroscopy to detect for unreacted acrylate groups.

EXAMPLE XII

Acrylation of 9/1 Copoly(styrene-chloromethylstyrene) of Example VIII

Example IX was repeated with the exception that 5 grams of the PS/PCMS copolymer were used. The polymer was characterized by $^1$H NMR, which indicated that 30 percent of the available chloromethyl groups had been substituted for acrylated methyl groups. GPC revealed only the expected molecular weight increase due to substitution. The total recovered polymer of copoly(chloromethylstyrene-acrylated methyl styrene-styrene) was 9.7 grams (95 percent yield). GPC Data: $M_w$=28,700, $M_n$=21,200, PD=1.25. Thin films of the random copolymer for UCL applications can be developed by imagewise exposure of the material to radiation at a wavelength to which it is sensitive. The crosslinking was enhanced by the addition of sensitizers, such as Michler's Ketone 4,4'-bis(dimethylamino) benzophenone, and the like compounds. Exposure to, for example, ultraviolet radiation generally excites ethylenic bonds in the acrylate groups and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylol sites and was about 60 to 65 percent crosslinked as measured by elemental analysis or Rutherford Backscattering Experiments to detect for residual chlorine and IR spectroscopy to detect for unreacted acrylate groups.

EXAMPLE XIII

Acrylation of 1:1 Copoly(styrene-chloromethylstyrene) from Example VIII

Example IX was repeated with the exception that 5 grams of the PS/PCMS copolymer was used. The polymer product was characterized by $^1$H NMR, which showed 21 percent of the available chloromethyl groups had been substituted by acrylated methyl groups. GPC revealed only the expected molecular weight increase due to substitution. The total recovered polymer of copoly(chloromethylstyrene-acrylated methyl styrene-styrene) was 5.2 grams (85 percent yield). GPC Data: $M_w$=14,400, $M_n$=11,600, PD=1.25. Thin films of this random copolymer can be developed by imagewise exposure of the material to radiation at a wavelength to which it is sensitive. Crosslinking was enhanced by the addition of sensitizers, such as Michler's Ketone 4,4'-bis (dimethylamino)benzophenone, and the like compounds. Exposure to, for example, ultraviolet radiation generally excites ethylenic bonds in the acrylate groups, and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylol sites was about 40 to 45 percent crosslinked as measured by elemental analysis or Rutherford Backscattering Experiments to detect for residual chlorine and IR spectroscopy to detect for unreacted acrylate groups.

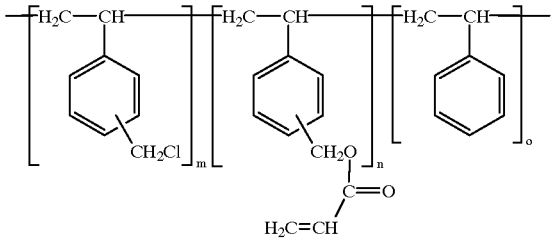

wherein m and n are as indicated herein, and 0 (zero) represents the number of segments.

EXAMPLE XIV

Acrylation of HomoPoly(chloromethylstyrene)

To 8 grams of the above prepared poly (chloromethylstyrene) polymer ($M_w$=26,300, $M_n$=21,200, PD=1.41) from Example VI dissolved in 30 milliliters of dimethylacetamide were added 5.7 grams of the sodium is salt of methacrylic acid. The mixture was stirred at 50° C. for 3 days in the dark. The partially methacrylated polymers were recovered by precipitation of the polymer solution into one liter of a water/methanol mixture (75/25) and the white polymer recovered by filtration, washed with excess methanol (2×150 milliliters) and allowed to air dry. The sample was further dried to remove residual solvent by vacuum for 16 hours. The polymer of copoly(chloromethylstyrene-acrylated methyl styrene) was characterized by $^1$H NMR which evidenced by the ratio of the chloromethyl groups to methacrylated methyl groups that approximately 37 percent of the chloromethyl groups had been substituted. Yield was 6.8 grams (90 percent). GPC Data: $M_w$=33,500, $M_n$=23,000, PD=1.45. Thin films of the random copolymer can be developed by imagewise exposure of the material to radiation at a wavelength to which it is sensitive. Crosslinking was enhanced by the addition of sensitizers, such as Michler's Ketone 4,4'-bis(dimethylamino)benzophenone, and the like compounds. Exposure to, for example, ultraviolet radiation generally excites ethylenic bonds in the acrylate groups and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylol sites and was about 70 to 75 percent crosslinked as measured by elemental analysis or Rutherford Backscattering Experiments to detect for residual chlorine and IR spectroscopy to detect for unreacted acrylate groups.

EXAMPLE XV

Dimethylaminoethylacrylation of Homopoly (chloromethylstyrene)

To 10 grams of the above prepared poly (chloromethylstyrene) polymer ($M_w$=26,300, $M_n$=21,200, PD=1.41) from Example VI dissolved into a solution containing a 50 milliliters mixture of a 70/30 ratio of THF/MeOH and 20 milliliters of dimethylethylaminoacrylate (0.15 mol). The mixture was stirred at 70° C. for 3 days in the dark. The partially aminoacrylated polymers were recovered by precipitation of the polymer solution into one liter of an isopropanol and the white polymer recovered by filtration. The sample was further dried to remove residual solvent by vacuum drying overnight. The polymer of copoly (chloromethylstyrene-dimethylaminoethylacrylated methyl styrene) was characterized by $^1$H NMR. The degree of substitution of 43 percent was calculated from the ratio of chloromethyl to aminomethylated protons. Yield was 7.4 grams (70 percent). GPC of this sample was not obtained since the product was THF insoluble. Thin films of the random copolymer can be developed by imagewise exposure of the material to radiation at a wavelength to which it is sensitive. Crosslinking was enhanced by the addition of sensitizers, such as Michler's Ketone 4,4'-bis (dimethylamino)benzophenone, and the like compounds. Exposure to, for example, ultraviolet radiation generally excites ethylenic bonds in the acrylate groups and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylol sites, and was about 75 to 80 percent crosslinked as measured by elemental analysis or Rutherford Backscattering Experiments to detect for residual chlorine and IR spectroscopy to detect for unreacted acrylate groups.

EXAMPLE XVI

One Pot Scaleup of the Partially Acrylated Polychloromethylstyrene by Stable Free Radical Polymerization (SFRP) in a Buchi Reactor In order to accommodate the larger bulk polymerization with effective heat transfer, a 2 liter stainless steel Buchi reactor equipped with programmable oil heating unit was used. In this bulk polymerization, the reactor was charged with 859 grams (5.24 mol, 800 milliliters) of chloromethylstyrene (Dow), 3.81 grams of the benzoyl peroxide initiator (Aldrich), and 3.25 grams of TEMPO (Nova Chemicals), purged with argon, and slowly heated to 135° C. Caution was taken to avoid exotherms during polymerization by closely monitoring the reaction temperature with an internal thermocouple. Reactions were periodically sampled and the degree of conversion measured by TGA and GPC. The reaction time for the homopolymerization of PCMS was similar to smaller scale polymerization done in glass, and effectively reached 90 percent conversion in less than about 4 hours. Afterwards, the bulk polymerization mixture was cooled to 50° C. to terminate the polymerization, and the solution was diluted with 1 liter of dimethylacetamide. Once the reaction solution had equilibrated to 50° C., dry sodium acrylate (129.6 grams, Aldrich) was introduced into the reactor in a slight molar excess with respect to the chloromethyl groups. Stirring was continued for 3 days at this temperature until the desired degree of substitution had been achieved. The reactor was then discharged and the solution diluted a further 50 percent with dimethylacetamide, and precipitated into a large excess of methanol (16 liters), isolated by filtration, white polymer was obtained. The starting material and product polymers of partially acrylated polychloromethylstyrene were characterized by GPC and $^1$H NMR as follows: 100 percent PCMS Base Resin: $M_w$=35,480, $M_n$=23,770, Mp=38,530, PD=1.49; and 85/15 percent PCMS/PAMS polymer: $M_w$=37,990, $M_n$=25110, Mp=43130, PD=1.51. Care was exercised to avoid inadvertent crosslinking of the sample by protecting the sample from light. Thin films of the random copolymer for UCL applications can be developed by imagewise exposure of the material to radiation at a wavelength to which it is sensitive. Crosslinking is enhanced by the addition of sensitizers, such as Michler's Ketone 4,4'-bis(dimethylamino) benzophenone. Exposure to, for example, ultraviolet radiation generally excites ethylenic bonds in the acrylate groups and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylol sites, and was about 70 to 75 percent crosslinked as measured by elemental analysis or Rutherford Backscattering Experiments to detect for residual chlorine and IR spectroscopy to detect for unreacted acrylate groups.

EXAMPLE XVII

One Pot Scaleup of the Partially Acrylated Copoly (chloromethylstyrene-styrene) by SFRP Polymerization in a Buchi Reactor To accommodate the larger bulk polymerization with effective heat transfer, a 2 liter stainless steel Buchi reactor equipped with a programmable oil heating unit was used. In these bulk polymerizations, the reactor was charged with 279.2 grams (1.7 m, 260 milliliters) of chloromethylstyrene (Dow), 444.6 grams (4.7 m, 489 milliliters) of styrene (Fluka), 3.5 grams of the benzoyl peroxide initiator (Aldrich), and 2.6 grams of TEMPO (Nova Chemicals), purged with argon, and slowly heated to 135° C. Caution was taken to avoid exotherms during polymerization by closely monitoring the reaction temperature with an internal thermocouple. Reactions were periodically sampled and the degree of conversion measured by TGA. With the homopolymeric sample PCMS, the reaction time was similar to smaller scale polymerization done in glass, and the sample had effectively reached 90 percent conversion in less than 4 hours. With the 70/30 PCMS copolymer, 75 percent conversion was achieved in 7 hours. In both reactions, the bulk polymerizations were cooled to 50° C. to terminate the polymerizations, and the solutions diluted with 1.5 liters of dimethylacetamide. Once the reaction solutions had equilibrated to 50° C., 200 grams of dry sodium acrylate (Aldrich) was introduced into the reactor in a slight excess. Stirring was continued for four days until all of the chloromethyl sites had been substituted with acrylate. The reactor was then discharged and the solution diluted 50 percent further with dimethylacetamide, and precipitated into a large excess of methanol (16 liters), isolated by filtration and dried under vacuum. A yield of about 75 percent of partially acrylated copoly(chloromethyl styrene-styrene) as an off white polymer was obtained. Materials were characterized by GPC and $^1$H NMR: 70/30 percent PS/PCMS Base Resin: $M_w$=36,900, $M_n$=25,910, Mp=40,940, PD=1.42; and 70/30 percent PS/PAMS polymer $M_w$=40,140, $M_n$=31,470, Mp=43,140, PD=1.28. Care was taken to avoid exposing the sample to light to avoid inadvertently crosslinking the material. Thin films of the random copolymer for UCL applications can be developed by imagewise exposure of the material to radiation at a wavelength to which it is sensitive. The crosslinking is enhanced by the addition of sensitizers, such as Michler's Ketone 4,4'-bis(dimethylamino)benzophenone. Exposure to, for example, ultraviolet radiation generally excites ethylenic bonds in the acrylate groups and leads to crosslinking at those sites which are in proximity to another acrylate ester group. Moreover, a secondary thermal cure can take place at about 260° C. between unreacted chloromethyl groups and aromatic rings of the polystyrene chain to form methylene bridges. The extent of crosslinking can vary from between 5 to up to 90 percent of the chloromethyl sites and acrylol sites and was about 50 to 55 percent crosslinked as measured by elemental analysis or Rutherford Backscattering Experiments to detect for residual chlorine and IR spectroscopy to detect for unreacted acrylate groups.

EXAMPLE XVIII

The modified PCMS prepared in Example IV can be selected as a hole blocking layer, and the Type V hydroxygallium phthalocyanine prepared in Example III can be selected as the photogenerating layer in a layered photoimaging member prepared by the following procedure. A titanized MYLAR® substrate, about 4 mil in thickness, was first coated with a coating solution prepared by dissolving 2 grams of PCMS of Example IV in 48 grams of dichloromethane using a 0.5 mil gap Gardner wet film blade applicator. The blocking layer so formed was dried at 100° C. for 20 minutes and the dried thickness was measured to be 0.3 micron. By using 1, 2, 3 and 4 mil gap Gardner wet film blade applicators, blocking layers with dried thicknesses of 0.6, 1.2, 2.6 and 3.5 microns, respectively, were prepared.

A dispersion was prepared by combining 0.5 gram of the HOGaPc prepared as described in Example III and 0.26 gram of poly(vinyl butaryl) in 25.2 grams of chlorobenzene in a 60 milliliter glass jar containing 70 grams of 0.8 milliliter glass beads. The dispersion was shaken on a paint shaker for 2 hours and then coated onto the PCMS blocking layer described above using a 0.5 mil Gardner wet film blade applicator. The Type V HOGaPc photogenerating layer formed was dried at 100° C. for 20 minutes to a final thickness of about 0.2 micron.

A hole transporting layer solution was prepared by dissolving 5.4 grams of N,N'-diphenyl-N,N-bis(3-methylphenyl)-1,1'-biphenyl-4,4'-diamine and 8.1 grams of polycarbonate in 61.5 grams of chlorobenzene. The solution was coated onto the Type V HOGaPc photogenerator layer using a 8 mil film applicator. The charge transporting layer thus obtained was dried at 115° C. for 60 minutes to provide a final thickness of about 22 microns.

The xerographic electrical properties of the photoresponsive imaging members prepared as described above were determined by electrostatically charging the surface thereof with a corona discharge source until the surface potential as measured by a noncontact electrostatic probe connected to an electrostatic voltmeter, attained an initial dark potential, $V_0$, of −800 volts. After resting for 0.5 second in the dark, the charged imaging member reached a surface potential of $V_{ddp}$ or dark development potential. The member was then exposed to filtered light from a Xenon lamp. The wavelength of the exposure light was 780 nanometers. A reduction in surface potential from $V_{ddp}$ to a background potential $V_{bg}$, due to the photodischarge was observed. The dark decay in volts per second was calculated as $(V_0-V_{ddp})/0.5$. The half exposure energy, $Eb_{1/2}$, the amount of exposure energy causing reduction of the $V_{ddp}$ to half its initial value, was determined. $E_{7/8}$ which is the amount of exposure energy causing reduction of the $V_{ddp}$ from −800 volts to −100 volts was also determined. The background potential was erased with an erase light of 780 nanometers and an intensity of about 45 ergs/cm$^2$. The residual potential after erase was measured as $V_{res}$. The effect of the thickness of the blocking layer on the electrical properties of the imaging member is shown in Table 1. Excellent electricals were obtained for blocking layers with thickness less than about 1.2 microns. For a thickness of 1.2 microns and greater, there can be higher residual potential.

TABLE 1

Xerographic Cycling Test Results

| Device # | Block Thickness μm | Dark Decay Volts/sec | $V_{res}$ Volts | $E_{1/2}$ ergs/cm$^2$ | $E_{7/8}$ ergs/cm$^2$ |
|---|---|---|---|---|---|
| PCMS-001 | 0.3 | 15 | 6 | 1.51 | 3.38 |
| PCMS-002 | 0.6 | 16 | 9 | 1.51 | 3.43 |
| PCMS-003 | 1.2 | 21 | 30 | 1.61 | 5.52 |
| PCMS-004 | 2.6 | 34 | 42 | 1.67 | 8.79 |
| PCMS-005 | 3.5 | 39 | 53 | 1.61 | 11.58 |

In a cycling test, devices were charged with a corotron to about −800 volts. They were exposed with 775 nanometers of light with an intensity of about 7 ergs/cm$^2$ and erased with white light of about 60 ergs/cm$^2$. The dark development potential $V_{ddp}$ and background potentials $V_{bg}$ were measured and recorded while the testing was performed for 10,000 cycles. The devices were mounted on a drum housed in a controlled environmental chamber. During the cycling tests, the chamber is operated at 20° C., 40 percent RH (Relative Humidity). Changes in the dark development potential $\Delta V_{ddp}$, background potential $\Delta V_{bg}$ and residual potential $\Delta V_{res}$ are determined after the cycling test.

TABLE 2

Xerographic Cycling Test Results

| Device No. | Block Layer Thickness μm | $\Delta V_{ddp}$ Volts | $\Delta V_{bg}$ Volts | $\Delta V_{res}$ Volts |
|---|---|---|---|---|
| PCMS-001 | 0.3 | −14 | 6 | 5 |
| PCMS-002 | 0.6 | −18 | 8 | 5 |
| PCMS-003 | 1.2 | −26 | 23 | 27 |

The results in Table 2 show that imaging members (Device PCMS-001 and PCMS-002) with blocking layer thickness of 0.3 and 0.6 micrometer exhibit excellent cycling stability, since the change in $V_{ddp}$ is less than 20 volts and changes in $V_{bg}$ and $V_{res}$ are less than 10 volts. An imaging member (Device PCMS-003) with the blocking layer thickness of about 1.2 micrometers shows a higher increase in $V_{bg}$ of 23 volts and in $V_{res}$ of 27 volts, an indication that the device is less stable on cycling.

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a hole blocking layer, an optional adhesive layer, a photogenerator layer, and a charge transport layer, and wherein said blocking layer is comprised of a polyhaloalkylstyrene.

2. An imaging member in accordance with claim 1 wherein said polyhaloalkylstyrene is polychloromethylstyrene.

3. An imaging member in accordance with claim 1 wherein said polyhaloalkylstyrene is copoly(chloromethylstyrene-styrene), copoly(chloromethylstyrene-acrylated methyl styrene), copoly(chloromethylstyrene-dimethylaminoethylacrylated methyl styrene) or copoly(chloromethylstyrene-trimethylaminoethylacrylated methyl styrene.

4. An imaging member in accordance with claim 1 wherein said polyhaloalkylstyrene possesses a $M_w$ of about 2,500 to about 1,000,000.

5. An imaging member in accordance with claim 1 wherein said polyhaloalkylstyrene possesses a $M_n$ of about 2,000 to about 800,000.

6. An imaging member in accordance with claim 1 wherein said polyhaloalkylstyrene is cured.

7. An imaging member in accordance with claim 6 wherein said polyhaloalkylstyrene is polychloromethylstyrene.

8. An imaging member in accordance with claim 6 wherein said curing is accomplished by heating.

9. An imaging member in accordance with claim 6 wherein said polyhaloalkylstyrene is crosslinked.

10. An imaging member in accordance with claim 6 wherein said curing is accomplished by ultraviolet processes.

11. An imaging member in accordance with claim 9 wherein said crosslinking is from about 5 to about 95 percent.

12. An imaging member in accordance with claim 11 wherein said polyhaloalkylstyrene is polychloromethylstyrene.

13. An imaging member in accordance with claim 1 wherein the photogenerator layer is situated between the substrate and the charge transport layer.

14. An imaging member in accordance with claim 1 wherein the supporting substrate is comprised of a conductive component comprised of a metal.

15. An imaging member in accordance with claim 14 wherein the conductive substrate is aluminum, aluminized polyethylene terephthalate or titanized polyethylene terephthalate.

16. An imaging member in accordance with claim 1 wherein said photogenerator layer is of a thickness of from about 0.05 to about 10 microns.

17. An imaging member in accordance with claim 1 wherein said transport layer is of a thickness of from about 5 to about 30 microns.

18. An imaging member in accordance with claim 1 wherein the photogenerating layer is dispersed in a resinous binder in an amount of from about 5 percent by weight to about 95 percent by weight.

19. An imaging member in accordance with claim 18 wherein the resinous binder is selected from the group consisting of polyesters, polyvinyl butyrals, polycarbonates, polystyrene-b-polyvinyl pyrridine, and polyvinyl formals.

20. An imaging member in accordance with claim 1 wherein said charge transport layer comprises aryl amine molecules.

21. An imaging member in accordance with claim 20 wherein the aryl amines are of the formula

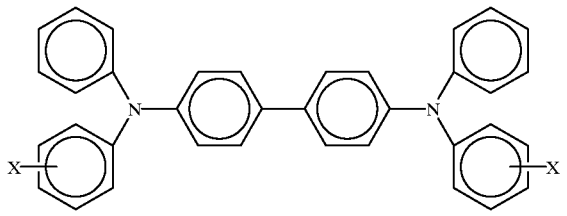

wherein X is selected from the group consisting of alkyl and halogen, and wherein the aryl amine is optionally dispersed in an insulating and transparent resinous binder.

22. An imaging member in accordance with claim 21 wherein the resinous binder is selected from the group consisting of polycarbonates and polystyrenes.

23. An imaging member in accordance with claim 21 wherein the aryl amines are molecules comprised of N,N'-diphenyl-N,N-bis(3-methyl phenyl)-1,1'-biphenyl-4,4'-diamine.

24. A method of imaging which comprises generating an electrostatic latent image on the imaging member of claim 1, developing the latent image, and transferring the developed electrostatic image to a suitable substrate.

25. An imaging member in accordance with claim 1 wherein the photogenerating layer is comprised of hydroxygallium phthalocyanine Type V.

26. An imaging member in accordance with claim 25 wherein the Type V hydroxygallium phthalocyanine is prepared by hydrolyzing a gallium phthalocyanine precursor pigment by dissolving said hydroxygallium phthalocyanine in an acid and then reprecipitating the resulting dissolved pigment in a basic aqueous media; concentrating the resulting mixture of water and hydroxygallium phthalocyanine into a wet cake; removing water from said wet cake by drying; and subjecting said resulting dry pigment to mixing with the addition of a second solvent to cause the formation of said hydroxygallium phthalocyanine.

27. A photoconductive imaging member in accordance with claim 1 wherein the supporting substrate has a thickness of from about 3 to 100 mils, and wherein the hole blocking layer has a thickness of from about 0.1 to 2 micrometers.

28. A photoconductive imaging member in accordance with claim 1 wherein the adhesive layer comprises a polymeric material selected from the group consisting of polyester, and polyvinylbutaryl and has a thickness of from about 0.01 to 0.1 micrometer.

29. An imaging member in accordance with claim 1 wherein said polyhaloalkylstyrene is copoly (halomethylstyrene-styrene), copoly(halomethylstyrene-acrylated methyl styrene), copoly(halomethyl styrene-acrylated methyl styrene-styrene), copoly (halomethylstyrene-dimethylaminoethylacrylated methyl styrene), or copoly(halomethylstyrene-trimethylaminoethylacrylated methyl styrene.

30. An imaging member in accordance with claim 1 wherein said blocking layer is of a thickness of from about 0.1 to about 3 microns.

31. An imaging member comprised of a polyhaloalkylstyrene, a photogenerating layer and a charge transport layer.

32. An imaging member in accordance with claim 1 wherein said polyhaloalkylstyrene is an acrylated polyhaloalkylstyrene.

33. An imaging member in accordance with claim 23 wherein said acrylated polyhaloalkylstyrene is crosslinked.

34. A photoconductive imaging member comprised of a supporting substrate, a hole blocking layer, an adhesive layer, a photogenerator layer, and a charge transport layer, and wherein said blocking layer is comprised of a polyhaloalkylstyrene.

35. An imaging member in accordance with claim 34 wherein said polyhaloalkylstyrene is copoly(chloromethylstyrene-styrene), copoly(chloromethylstyrene-acrylated methyl styrene), copoly(chloromethyl styrene-dimethylaminoethylacrylated methyl styrene) or copoly (chloromethyl styrene-trimethylaminoethylacrylated methyl styrene.

36. An imaging member in accordance with claim 34 wherein said polyhaloalkylstyrene is polychloromethylstyrene.

37. A photoconductive imaging member consisting essentially of a supporting substrate, a hole blocking layer, an adhesive layer, a photogenerator layer, and a charge transport layer, and wherein said blocking layer is comprised of a polyhaloalkylstyrene.

38. An imaging member in accordance with claim 34 wherein the aryl amines are of the formula

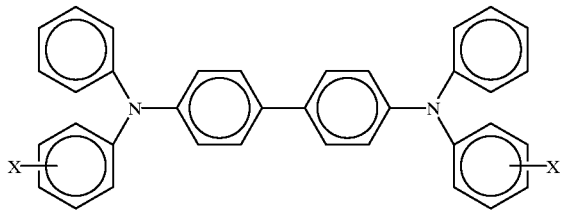

wherein X is selected from the group consisting of alkyl and halogen, and wherein the aryl amine is optionally dispersed in an insulating and transparent resinous binder.

* * * * *